United States Patent [19]

Borostyan

[11] Patent Number: 5,031,004

[45] Date of Patent: Jul. 9, 1991

[54] DEVELOPEMENT MODULE FOR A COLOR PRINTER PROVIDED UNIT TOWER SEATS

[75] Inventor: Stephen Borostyan, Victor, N.Y.

[73] Assignee: Xerox Corporation, Stamford, Conn.

[21] Appl. No.: 485,011

[22] Filed: Feb. 26, 1990

[51] Int. Cl.[5] ..... G03G 15/01; G03G 15/06

[52] U.S. Cl. ..... 355/327; 355/245

[58] Field of Search ..... 355/326, 327, 245, 260, 355/215

[56] References Cited

U.S. PATENT DOCUMENTS

| | | | |
|---|---|---|---|
| 3,627,410 | 12/1971 | Jugle | 355/326 |
| 3,797,930 | 3/1974 | Tanaka et al. | 355/326 |
| 3,872,826 | 3/1975 | Hanson | 355/245 X |
| 3,970,383 | 7/1976 | Honda et al. | 355/327 |
| 3,976,372 | 8/1976 | Miyata et al. | 355/327 |
| 4,077,358 | 3/1978 | Kito | 355/251 X |
| 4,097,139 | 6/1978 | Hauser et al. | 355/326 |
| 4,358,195 | 11/1982 | Kuehnle et al. | 355/327 |
| 4,436,413 | 3/1984 | Oka | 355/253 |
| 4,452,173 | 6/1984 | Tabuchi et al. | 118/652 |
| 4,456,367 | 6/1984 | Szymanski et al. | 355/327 X |
| 4,754,301 | 6/1988 | Kasamura et al. | 355/326 X |
| 4,841,329 | 6/1989 | Kasamura et al. | 355/245 |
| 4,841,336 | 6/1989 | Kusumoto et al. | 355/245 |
| 4,882,605 | 11/1989 | Sakamoto | 355/326 X |

FOREIGN PATENT DOCUMENTS

| | | | |
|---|---|---|---|
| 0120372 | 6/1985 | Japan | 355/326 |
| 0077875 | 4/1986 | Japan . | |

*Primary Examiner*—A. T. Grimley
*Assistant Examiner*—Nestor R. Ramirez
*Attorney, Agent, or Firm*—H. Fleischer; J. E. Beck; R. Zibelli

[57] ABSTRACT

An apparatus in which successive developer units are moved to a development zone to develop with different color toner successive latent images recorded on a photoconductive member. Developer units remote from the development zone are sealed to prevent the escape of toner therefrom and the contamination of the developer unit.

14 Claims, 2 Drawing Sheets

DEVELOPEMENT MODULE FOR A COLOR PRINTER PROVIDED UNIT TOWER SEATS

Figure 1:
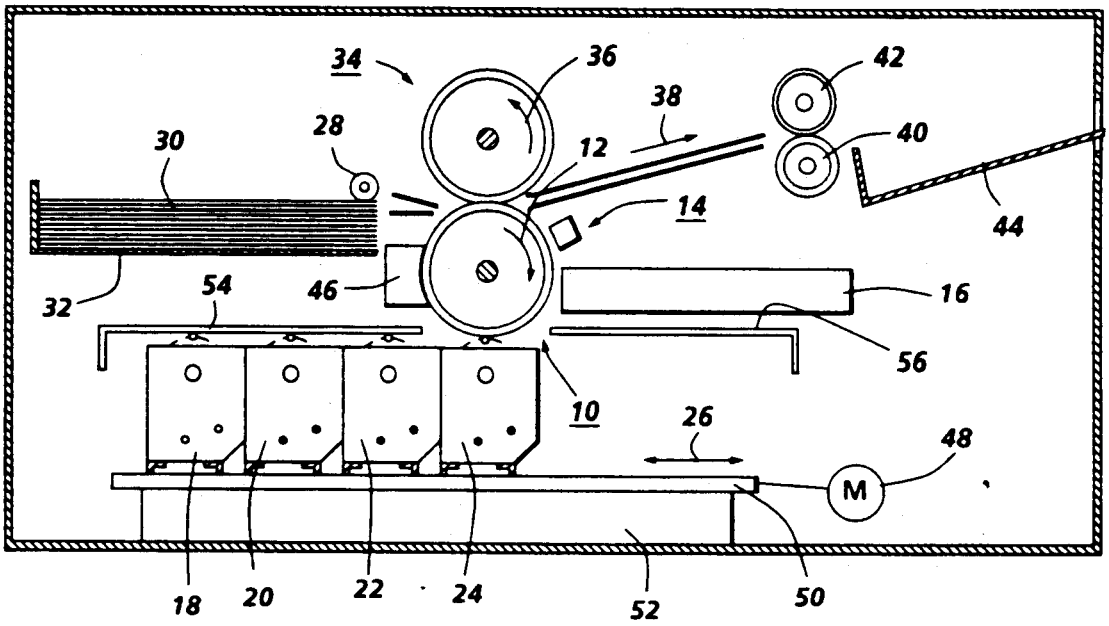

This invention relates generally to a color electrophotographic printing machine, and more particularly concerns a horizontally indexable and sealable development system.

In an electrophotographic printing machine, a photoconductive member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a powder image on the photoconductive member which is subsequently transferred to a copy sheet. The copy sheet is heated to permanently affix the marking particles thereto in image configuration.

Multi-color electrophotographic printing is substantially identical to the foregoing process of black and white printing. However, rather than forming a single latent image on the photoconductive surface, successive latent images corresponding to the different colors desired in the copy. Each single color electrostatic latent image is developed with the appropriately colored toner. The single color toner images are transferred to the copy sheet in superimposed registration with one another. This creates a multi-layered toner image on the copy sheet. Thereafter, the multi-layered toner image is permanently affixed to the copy sheet creating a color copy. The developer material may be a liquid material or a powder material.

Generally, development systems used in multi-color printing machines have three or four individual developer unit. One of the developer units is operative with the other developer units being nonoperative. A different developer units is operative to develop each latent image. In this way, each latent image is developed with a different color toner. It is desirable to minimize the distance that the developer units move between the operative and non-operative position. This reduces the space between successive latent images increasing machine productivity. Preferably, the developer units are customer replaceable units. In addition, it is necessary to minimize the escape of toner from the developer units to maintain a clean printing machine. Contamination to and from the developer units will degrade copy quality. Various type of development systems have been devised for multi-color printing. The following disclosures appear to be relevant:

U.S. Pat. No. 3,797,930 Patentee: Tanaka et al. Issued: Mar. 19, 1974.

U.S. Pat. No. 3,976,372 Patentee: Miyata et al. Issued: Aug. 24, 1976.

U.S. Pat. No. 4,097,139 Patentee: Hauser et al. Issued: June 27, 1978.

U.S. Pat. No. 4,358,195 Patentee: Kuehnle et al. Issued: Nov. 9, 1982.

U.S. Pat. No. 4,456,367 Patentee: Szymanski et al. Issued: June 26, 1984.

U.S. Pat. No. 4,841,329 Patentee: Kasamura et al. Issued: June 20, 1989.

U.S. Pat. No. 4,841,336 . Patentee: Kusumoto et al. Issued: June 20, 1989.

The relevant portions of the foregoing patents may be briefly summarized as follows:

U.S. Pat. No. 3,797,930 discloses an electrophotographic printing machine having a plurality of developer units which move beneath a drum having a sheet with a latent image recorded thereon. Each developer unit contains a different color liquid developer material. The developer units are independent of one another so as to prevent mixing of colors.

U.S. Pat. No. 3,976,372 describes a multi-color electrophotographic reproduction machine in which a developer bed has a plurality of developer reservoirs mounted thereon. Each reservoir contains a different color toner. The developer bed moves horizontally to position a proper reservoir with the appropriate color at a development station. This is repeated for each required color to produce a composite color image.

U.S. Pat. No. 4,097,139 discloses a reproduction machine having interchangeable developer housings. One unit is mounted in the reproduction machine and the other unit remote therefrom. The developer units have different color toner. Color changes are achieved by interchanging the developer housings.

U.S. Pat. No. 4,358,195 describes a color proofing machine which has a plurality of toning units. Each toning plate has a bias plate and is movable linearly beneath the plate. A selected toning unit is activated to apply a selected color toner to an electrophotographic member. This process is repeated for each color.

U.S. Pat. No. 4,456,367 discloses a toning system for an electrostatic imaging apparatus. A plurality of toning modules are positioned side by side at a first level. Each module has a toner tray with a developing electrode on an upper surface. A motor operates a linkage which causes a selected tray to be elevated to a second level for toning a photoconductive surface. The modules are successively moved into position to complete a color image.

U.S. Pat. No. 4,841,329 and U.S. Pat. No. 4,841,336 describe an image forming apparatus which accommodates a plurality of developer devices arranged substantially vertically. A first drive mechanism moves the developing devices into a substantially horizontal plane. An image formation assembly receives a selected one of the developer devices and moves the device to a position adjacent an image bearing member.

Pursuant to the features of the present invention, there is provided a apparatus for developing successive latent images recorded on a photoconductive member with different color toner at a development zone. The apparatus includes a plurality of developer units with each developer unit being adapted to develop the latent image recorded on the photoconductive member with different color toner. Means are provided for moving the plurality of developer units to position one of the developer units in the development zone. Means seal the developer units remote from the development zone to prevent the escape of toner therefrom and the contamination of the toner.

In another aspect of the present invention, there is provided a printing machine of the type in which successive latent images recorded on a photoconductive member are developed with different color toner at a development zone. The printing machine includes a plurality of developer units with each developer unit being adapted to develop the latent image recorded on the photoconductive member with different color toner. Means are provided for moving the plurality of developer units to position one of the developer units in the development zone. Means seal developer units remote from the development zone to prevent the escape of toner therefrom and the contamination of the toner.

Figure 2:
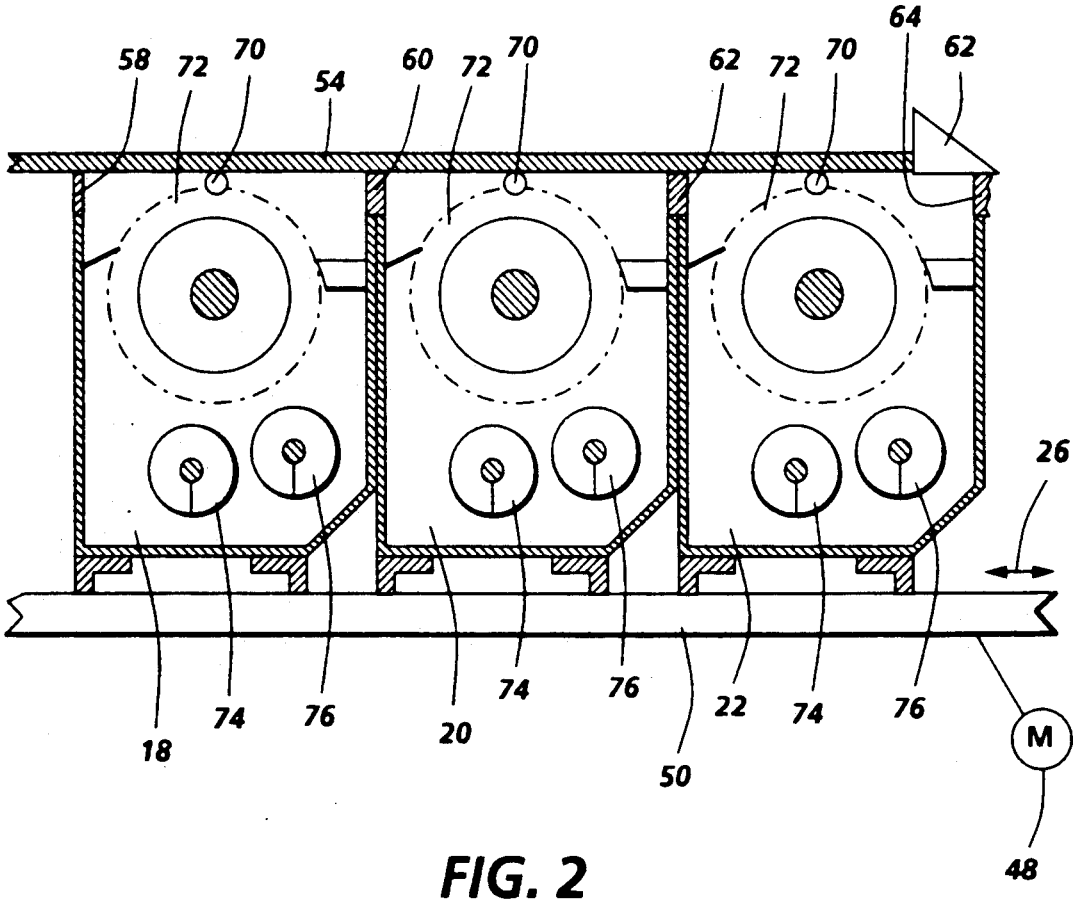

Other aspects of the present invention will become apparent as the following description proceeds and upon reference to the drawings, in which:

FIG. 1 is a schematic elevational view illustrating a color electrophotographic printing machine incorporating the features of the present invention therein; and FIG. 2 is a schematic elevational view showing the development apparatus of the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 depicts a color electrophotographic printing machine incorporating the features of the present invention therein. It will become evident from the following discussion that the present invention is equally well suited for use in a wide variety of printing machines, and is not necessarily limited in its application to the particular machine shown herein.

Turning initially to FIG. 1, there is shown a color electrophotographic printing machine employing a photoconductive drum 10. Preferably, photoconductive drum 10 is made from a photoconductive material such as selenium. However, any suitable photoconductive material may be used. Drum 10 rotates in the direction of arrow 12 to advance successive portions of the photoconductive surface sequentially through the various processing stations disposed about the path of movement thereof.

Initially, a portion of photoconductive drum 10 passes through the charging station. At the charging station, a corona generating devices, indicated generally by the reference numeral 14 charges photoconductive drum 10 to a relatively high, substantially uniform potential.

Next, the charged photoconductive surface is rotated to the exposure station. The exposure station includes an electronic subsystem that transmits a set of signals corresponding to a series of raster scan lines of different colors for the copy. These signals are transmitted to a raster output scanner (ROS) 16. ROS 16 includes a laser with rotating polygon mirror blocks. Preferably, a nine facet polygon is used. The ROS illuminates the charged portion of photoconductive drum 10 at a rate of about 400 pixels per inch. The ROS will expose the photoconductive belt to record three latent images. A person skilled in the art will appreciate that other imaging devices may be used in lieu of the ROS, e.g. an image bar. One latent image is adapted to be developed with cyan developer material. Another latent image is adapted to be developed with magenta developer material with the third latent image being developed with yellow developer material. The latent images formed by the ROS on the photoconductive drum correspond to the signals from the electronic subsystem.

After the electrostatic latent image has been recorded on photoconductive drum 10, drum 10 advances the electrostatic latent image to the development station. The development station includes four individual developer units generally indicated by the reference numerals 18, 20, 22 and 24. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 18, 20 and 22, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive drum corresponding to the green regions will record the red and blue portions as areas of relatively high charge density on photoconductive drum 10, while the green areas will be reduced to a voltage level ineffective for development. The charged areas are then made visible by having developer unit 18 apply green absorbing (magenta) toner particles onto the electrostatic latent image recorded on photoconductive drum 10. Similarly, a blue region is developed by developer unit 20 with blue absorbing (yellow) toner particles, while the red region is developed by developer unit 22 with red absorbing (cyan) toner particles. Developer unit 24 contains black toner particles and may be used to develop the electrostatic latent image formed from a black and white original document. Each of the developer units is moved into and out of the operative position. In the operative position, the developer unit is in the development zone with the magnetic brush being closely adjacent and self spaced from the photoconductive drum, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without co-mingling. In FIG. 1, developer unit 24 is shown in the operative position with developer units 18, 20 and 22 being in the non-operative position. The developer units in the non-operative position are sealed to prevent the escape of toner therefrom and to prevent contamination of the developer material in each developer unit. A shield or cover 54, located on one side of the development zone, seals the non-operative developer units located on that side of the development zone. A similar shield or cover 56, located on the other side of the development zone, seals the non-operative developer units located on that side of the development zone. A motor 48 coupled to developer carriage 50 translates the developer units in a horizontal direction, as indicated by arrow 26, between the non-operative positions and the operative position. A housing 52 having a chamber therin, is mounted beneath developer carriage 50 for storing waste toner. Further details of the development system will be discussed hereinafter with reference to FIG. 2.

After development, the toner image is moved to the transfer station where the toner image is transferred to a sheet of support material, such as plain paper amongst others. At the transfer station, the sheet feeder, indicated generally by the reference numeral 28, separates the uppermost sheet from a stack of sheets 30 supported on tray 32. The sheet is advanced to a transfer drum, indicated generally by the reference numeral 34, and secured removably thereon by sheet grippers holding the leading edge of the sheet. Transfer drum 34 is coupled by gears to rotate in synchronism with drum 10 in the direction of arrow 36. A voltage source (not shown) electrically biases transfer drum 34 to attract the toner image from photoconductive drum 10 to the sheet. This occurs as the sheet moves into the nip defined by transfer drum 34 and photoconductive drum 10. The sheet remains secured to the transfer drum so as to move in a recirculating path for three cycles. In this way, three different color toner images are transferred to the sheet in superimposed registration with one another. Each of the electrostatic latent images recorded on the photoconductive surface are developed with the appropriately colored toner which is transferred, in superimposed registration with one another to the sheet to form the multi-color copy.

After the last transfer operation, the grippers open and release the sheet. A conveyor transports the sheet, in the direction of arrow 38, to the fusing station where the transferred image is permanently fused to the sheet. The fusing station includes a heated fuser roll 40 and a pressure roll 42. The sheet passes through the nip defined by fuser roll 40 and pressure roll 42. The toner image contacts fuser roll 40 so as to be affixed to the sheet. Thereafter, the sheet is advanced to catch tray 44 for subsequent removal therefrom by the machine operator.

A blade cleaner, indicated generally by the reference numeral 46, is periodically moved into and out of contact with drum 10. The blade cleaner is moved into contact with the photoconductive drum when there is no toner image thereon so as to remove residual toner particles remaining after the transfer operation. Any residual charge remaining on the photoconductive drum is also removed therefrom prior to the start of the next successive cycle by illuminating drum 10.

Referring now to FIG. 2, there is shown further details of the development system. Developer units 18, 20 and 22 are illustrated in the non-operative position. Each developer unit has a roller 70 located on opposed ends of the developer roller 72 for spacing the developer roller from the photoconductive drum. Rollers 70 also space developer rollers 72 from shields 54 and 56. Each developer unit has a pair of augers 74 and 76 for mixing and transporting developer material to the developer roller. The developer units are mounted on a developer carriage 50 which is mounted on slides secured to the frame of the printing machine. In this way, developer carriage 50 may move slidable in the directions of arrow 26 while shield 54 remains stationary. Furthermore, this slidable mounting for the developer carriage enables the developer carriage with the developer units to be readily removed from the printing machine for maintenance or replacement. Thus, the development system may be a customer replacement unit. A gear train driven by motor 48 meshes with a rack secured to developer carriage 50, Energization of motor 48 indexes developer carriage 50 horizontally to position successive developer units in the operative position, i.e. development zone. Shield 54 is a plate, as is shield 56 (FIG. 1) which is stationary. Extending upwardly from the uppermost periphery of each developer unit is a seal adapted to be in sliding engagement with either shield 54 or shield 56. As shown in FIG. 2, seals 58 and 60 extend from developer unit 18 into sliding with shield 54. Seals 60 and 62 extend from developer unit 20 into sliding engagement with shield 54. Seals 62 and 64 extend from developer unit 22 into sliding engagement with shield 54. The seals between the developer units and the shield may be a mechanical seal. By way of example, seals 58, 60, 62 and 64 may be made from a polyurethane material. In addition, a magnetic seal 62 is also provide at the end of shield 54. Inasmuch as the developer material includes magnetic carrier granules and non-magnetic toner particles, the magnetic carrier granules are trapped by the magnet and form an additional seal in conjunction with the polyurethane seals to prevent the scape of toner from the developer unit. However, one skilled in the art will appreciate that any suitable material normally used as a seal which will have the required life when in sliding engagement with a plate may be used. Shield 54 or shield 56 may have trap doors which are actuated by the movement of a developer unit to the toner replenishment position. Toner containers are mounted stationarily adjacent each of the trap door and are adapted to discharge toner of the appropriate color into the developer units located in the toner replenishment positions.

In recapitulation, the apparatus of the present invention develops successive latent images recorded on a photoconductive member with different color toner. Successive developer units containing different color toner are indexed horizontally from a non-operative position to an operative position at the development zone. In the non-operative position, the developer units are sealed to prevent the escape of toner therefrom.

It is, therefore, evident that there has been provided in accordance with the present invention, An apparatus for developing successive latent images with different color toner that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing successive latent images recorded on a photoconductive member with different color toner at a development zone, including:

a plurality of developer units with each developer unit being adapted to develop the latent image recorded on the photoconductive member with different color toner;

means for translating simultaneously each one of said plurality of developer units solely in a common planar direction to position one of said developer units in the development zone; and means for sealing and isolating each developer unit remote from the development zone to prevent the escape of toner therefrom and the contamination of the toner, said sealing means being stationary with said translating means translating said plurality of developer units relative thereto to position one of said developer units in the development zone, said sealing means sealing and isolating each of said plurality of developer units from one another to prevent intermingling of plurality of developer units from one another to prevent intermingling of toner particles between adjacent developer units.

2. An apparatus according to claim 1, wherein said sealing means includes:

a first stationarily mounted plate located on one side of the development zone; and a second stationarily mounted plate, spaced from said first plate, located on the other side of the development zone.

3. An apparatus for developing successive latent images recorded on a photoconductive member with different color toner at a development zone, including:

a plurality of developer units with each developer unit being adapted to develop the latent image recorded on the photoconductive member with different color toner;

means for moving said plurality of developer units to position one of said developer units in the development zone, said moving means solely and simultaneously indexes each one of said plurality of developer units in a horizontal direction to position successive developer units adjacent the development zone; and means for sealing and isolating each developer unit remote from the development zone to prevent the escape of toner therefrom and the contamination of the toner, said sealing means comprises a first plate located on one side of the development zone, and a second plate, spaced from said first plate, located on the other side of the development zone, said sealing means sealing and isolating each of said plurality of developer units from one another to prevent intermingling of toner particles between adjacent developer units.

4. An apparatus according to claim 3, wherein said moving means includes:

a generally planar member having said plurality of developer units mounted thereon; and drive means for moving said planar member in a horizontal direction.

5. An apparatus according to claim 4, wherein said drive means includes:

means for supporting slidingly said planar member;

a motor; and means, coupling said planar member to said motor so that energization of said motor slides said planar member on said supporting means to move said plurality of developer units mounted thereon.

6. An apparatus according to claim 3, further including means for forming a seal between each one of said plurality of developer units and said first plate and said second plate as said moving means moves said plurality of developer units.

7. An apparatus according to claim 3, further including means for supplying periodically additional toner to each one of said plurality of developer units at a location remote from the development zone.

8. A printing machine of the type in which successive latent images recorded on a photoconductive member are developed with different color toner at a development zone, including:

a plurality of developer units with each developer unit being adapted to develop the latent image recorded on the photoconductive member with different color toner;

means for translating simultaneously each one of said plurality of developer units solely in a common planar direction to position one of said developer units in the development zone; and means for sealing and isolating each developer unit remote from the development zone to prevent the escape of toner therefrom and the contamination of the toner, said sealing means being stationary with said translating means translating said plurality of developer units relative thereto to position one of said developer units in the development zone, said sealing means sealing and isolating each of said plurality of developer units from one another to prevent intermingling of toner particles between adjacent developer units.

9. A printing machine according to claim 8, wherein said sealing means includes:

a first stationarily mounted plate located on one side of the development zone; and a second stationarily mounted plate, spaced from said first plate, located on the other side of the development zone.

10. A printing machine of the type in which successive latent images recorded on a photoconductive member are developed with different color toner at a development zone, including:

a plurality of developer units with each developer unit being adapted to develop the latent image recorded on the photoconductive member with different color toner;

means for moving said plurality of developer units to position one of said developer units in the development zone, said moving means solely and simultaneously indexes each one of said plurality of developer units to position successive developer units in a horizontal direction adjacent the development zone; and means for sealing and isolating each developer unit remote from the development zone to prevent the escape of toner therefrom and the contamination of the toner, said sealing means comprises a first plate located on one side of the development zone, and a second plate, spaced from said first plate, located on the other side of the development zone, said sealing means sealing and isolating each of said plurality of developer units from one another to prevent intermingling of toner particles between adjacent developer units.

11. A printing machine according to claim 10, wherein said moving means includes:

a generally planar member having said plurality of developer units mounted thereon; and drive means for moving said planar member in a horizontal direction.

12. A printing machine according to claim 11, wherein said drive means includes:

means for supporting slidingly said planar member;

a motor; and means, coupling said planar member to said motor so that energization of said motor slides said planar member on said supporting means to move said plurality of developer units mounted thereon.

13. A printing machine according to claim 11, further including means for forming a seal between each one of said plurality of developer units and said first plate and said second plate as said moving means moves said plurality of developer units.

14. A printing machine according to claim 11, further including means for supplying periodically additional toner to each one of said plurality of developer units at a location remote from the development zone.

* * * * *